United States Patent [19]

Cerier

[11] Patent Number: 4,831,730

[45] Date of Patent: May 23, 1989

[54] RAZOR WITH STACKABLE CARTRIDGE

[75] Inventor: Jeffrey C. Cerier, Franklin, Mass.

[73] Assignee: The Gillette Company, Boston, Mass.

[21] Appl. No.: 127,912

[22] Filed: Dec. 2, 1987

[51] Int. Cl.[4] ..... B26B 21/14

[52] U.S. Cl. ..... 30/47; 30/85; 132/289

[58] Field of Search ..... 30/34 R, 40, 40.2, 47, 30/50, 51, 85, 90; 132/80 R; 206/352, 354, 208, 228

[56] References Cited

U.S. PATENT DOCUMENTS

| | | | |
|---|---|---|---|
| 3,771,223 | 11/1973 | Dawidowicz et al. | 30/50 X |
| 4,432,452 | 2/1984 | Kelly | 206/354 |
| 4,496,047 | 1/1985 | Gatley | 206/354 |

FOREIGN PATENT DOCUMENTS

| | | | |
|---|---|---|---|
| 2166380 | 5/1986 | United Kingdom | 30/47 |

*Primary Examiner*—Frank T. Yost
*Assistant Examiner*—Michael D. Folkerts
*Attorney, Agent, or Firm*—Owen J. Meegan; Aubrey C. Brine; Scott R. Foster

[57] ABSTRACT

A safety razor assembly is provided comprising a plurality of stacked discrete shaving elements. Each of the shaving elements contains a shaving head mounted in an upwardly facing enclosure, and wall structure forming a downwardly facing cavity for receiving the shaving head enclosure of another shaving element in interfitting engagement therewith. The assembly comprises a sufficient quantity of elements that, when stacked one upon the other, form a gripping handle which is employed when using the topmost shaving head in the shaving process. An overcap is provided having an upwardly projecting protuberance with side wall dimensions equal to those of each shaving head enclosure and a downwardly facing cavity having interal dimensions equal to those of each shaving head cavity. The elements are removed from the top of the stack and placed at the bottom after use, the overcap being returned at the top of the stack during storage of the storage of the razor assembly for protective purposes, and retained at the bottom of the stack during shaving process, to prevent its being misplaced.

12 Claims, 1 Drawing Sheet

RAZOR WITH STACKABLE CARTRIDGE

BACKGROUND OF THE INVENTION

The present invention relates to safety razor assemblies, and more particularly to a safety razor assembly of the disposable type.

In the field of safety razors, numerous improvements have been made over recent years which have provided safety razor assemblies intended to meet with the lifestyle of the modern day user. Lightweight razor assemblies have been introduced which are provided with disposable cartridges and various styles of disposable razors are in the marketplace. Many of these items have been minaturized and are therefore easily stored and carried with other toiletry items, which is an important feature to the traveler.

Both the safety razor assemblies employing disposable cartridges, as well as the disposable razor assemblies have met with great success in the marketplace. However, in the use of a safety razor employing disposable cartridges containing the shaving head, it is necessary for the user to carry that portion of the razor assembly containing the handle and cartridge receiving mechanism, as well as a plurality of cartridges which are generally stored in a separate container. With the use of disposable razors, the user is required to carry a plurality of such individual razor assemblies in order to maintain an adequate supply.

The present invention therefore has as an object to provide a safety razor assembly incorporating the advantages and desirable features of both the cartridge type safety razor assembly and the disposable type razor assembly embodied into an easily transportable unitary element.

A further object of the invention is to provide a safety razor assembly of the cartridge type wherein a plurality of cartridges are employed in the basic razor assembly, eliminating the need for separate storage of cartridges and the possibility of misplacing the cartridges when separated from the basic safety razor structure.

Still a further object of the invention is to provide a safety razor assembly of the disposable type containing a plurality of cartridges containing shaving heads, which cartridges are employed as a gripping handle during the shaving process.

Another object of the invention is to provide a safety razor assembly which is lightweight in structure, simple to manufacture, and is easily transportable by the user.

SUMMARY OF THE INVENTION

The aforementioned objects and other objectives which will become apparent as the description proceeds are accomplished by providing a safety razor assembly comprising a plurality of discrete elements disposed in stacked relation one with the other, each of said elements having an upwardly facing wall structure providing a housing having a shaving head disposed therein. Each of said elements further has a downwardly facing wall structure forming a cavity for receiving the shaving head housing of another element in interfitting engagement therewith such that each of the elements is stackable one on the other to form a handle for employing the shaving head of the upper most element during the shaving process.

The safety razor assembly may be provided with an overcap, the overcap having an upwardly facing wall structure forming a protuberance and a downwardly facing wall structure forming a cavity, the overcap upwardly facing protuberance wall structure being dimensioned for interfitting engagement into a cavity of a discrete element of the razor assembly, and the overcap cavity being dimensioned for receiving the shaving head housing of one of said elements in interfitting engagement whereby the overcap may be assembled at the top or the bottom of a plurality of discrete elements in stacked relation one with the other.

Each of the discrete elements are preferably identical one with the other and the shaving head housing and its mating cavity are substantially rectangular in horizontal cross-section. The shaving head housing and cavity are preferably formed of a resilient plastic material and are constructed such that there is an interference fit between the cavity and housing when a shaving head housing of one of the elements is in interfitting engagement with a cavity of another of the elements.

BRIEF DESCRIPTION OF THE DRAWING

The foregoing and other features of the invention will be more particularly described in connection with the preferred embodiment, and with reference to the accompanying drawing, wherein.

DESCRIPTION OF THE PREFERRED EMBODIMENT

Figure 1:
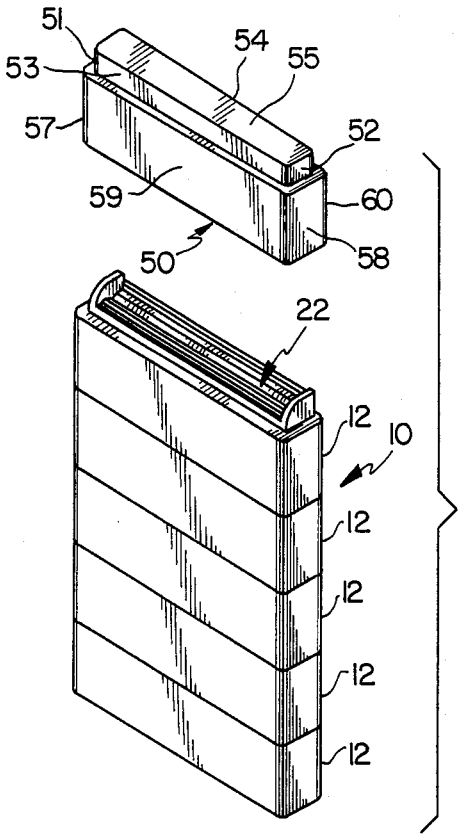
FIG. 1 is an exploded perspective elevational view showing a safety razor assembly constructed in accordance with the teachings of the present invention.
Figure 2:
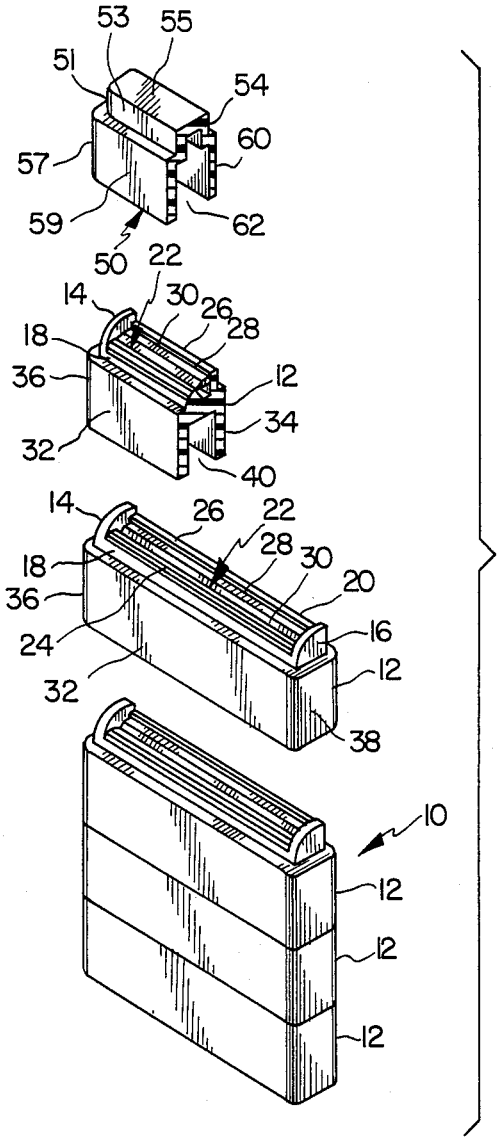
FIG. 2 is an exploded perspective elevational view partially in section showing details of the structure of FIG. 1.

Referring to FIGS. 1 and 2 of the drawing, there is shown a safety razor assembly 10 comprising a plurality of discrete elements 12 disposed in stacked relation one with the other. As best shown in FIG. 2, each of the discrete elements 12 comprises an upwardly facing wall structure formed of a pair of side walls 14 and 16, a front wall 18 and a rear wall 20. The upwardly facing wall structure forms a housing for a shaving head 22 which may be a shaving head of any type well known in the art, adaptable to a cartridge configuration.

The shaving head 22, as shown, comprises a guard surface 24 disposed adjacent the front wall 18 and a rear skin contacting surface 26 formed adjacent the rear wall 20. A pair of blades 28 and 30 are disposed between the guard 24 and the surface 26 in the proper geometry to provide a comfortable operating shaving surface to the user.

Each of the elements 12 is further provided with downwardly projecting wall structures including a front wall 32, a rear wall 34 and a pair of side walls 36 and 38 which form a downwardly facing cavity 40. The downwardly facing cavity 40 of each of the elements 12 is dimensioned such that the shaving head 22 of one of the elements 12 is received in interfitting engagement with the cavity 40 of another element when the elements are stacked one upon the other, as shown in FIG. 1. As may be seen in FIG. 2, the wall structure formed by the walls 14, 16, 18 and 20 are substantially rectangular in cross-section as are the downwardly projecting walls 32, 34, 36 and 38 of an adjacent element 12 and therefore may be constructed to provide an interference fit when one shaving head housing is inserted into the cavity 40 of another of the discrete elements 12 to form the safety razor assembly 10, as shown in FIG. 1. The interference fit between the cavity 40 and the shaving head wall structure of an adjacent element 12 may be achieved by constructing the elements 12 such that the dimensions of the wall structure formed in the cavity 40 is a forced fit over the wall structure enclosing the shaving head 22 or a detent or latching arrangement (not shown) as is well known in the art may be formed between the inner surfaces of the walls 14, 16, 18 or 20 and the walls 32, 34, 36, and 38. In order to provide the interfitting engagement between the elements 12, the wall structure providing the housing for the shaving head 22 and the wall structure forming the cavity 40 are preferably formed of a resilient plastic material suitable for ease of assembly of the elements 12 one upon the other in the stacked relation in the aforementioned interfitting engagement one with the other.

Referring to FIG. 1, it will noted that an overcap 50 is provided in the assembly 10, the overcap having an upwardly projecting wall structure including a pair of side walls 51 and 52, a front wall 53 and a rear wall 54 to provide a protuberance 55 extending upwardly from the overcap 50.

The overcap 50 further comprises a downwardly projecting wall structure including a pair of side walls 57 and 58, a front wall 59 and rear wall 60 which form a cavity 62 as best shown in FIG. 2. The cavity 62 is identical in dimension to the cavity 40 of an element 12 and the internal wall structure of the cavity 62 is constructed for to produce an interference fit with an enclosure of a shaving head 22 when placed over the wall structure forming the shaving head enclosure. In like fashion, the wall structure including the external surfaces of the side walls 51 and 52, the front wall 53 and the rear wall 54 of the protuberance 55 form an interfitting engagement when introduced into the cavity 40 of an element 12. The overcap 50 is constructed of a resilient plastic material which may be the same material as that forming the discrete elements 12, or of a different material however being flexible in providing a tight fit when the protuberance 55 is inserted into a cavity 40, or a shaving head 22 and its enclosure wall structure is inserted into the cavity 62.

In operation, the discrete elements 12 are stacked one upon the other as shown in FIG. 1 with the overcap 50 disposed at the top of the stack. As will be observed, the outer wall structure of the elements 12 as well as the overcap 50 are identical such that the assembly produced is substantially a rectangular body which may be simply carried with other toiletry items without requiring a large volume of space or without providing sharp edges which may contact other items carried in an overnight bag or other transporting means.

With the overcap 50 removed, the upper most element 12 provides a shaving head 22 which is located for use and the remainder of the elements 12 form a handle which is gripped by the user during the shaving process. Generally, the user will assemble the overcap 55 onto the lower element 12 to prevent its loss, or being misplaced, during the shaving operation.

While the present embodiment shows a stack of five elements 12 and the overcap 50, it should be understood that the number of elements 12 may vary as well as the height dimension of each element, the heighth of elements, and number of elements, being of sufficient magnitude to provide a suitable handle for gripping by the user during the shaving process.

When the element 12 which has been employed at the top of the stack is no longer usable, it is transferred to the bottom of the stack where it provides a useful purpose as a portion of the handle of the assembly 10 and the element 12 and its having head 22 which now lie at the top of the stack, are employed during the shaving process.

From the foregoing, it is considered that the present invention provides a safety razor assembly combining the better qualities of a cartridge type razor as well as a disposable razor which have been combined in a singular package which is simple to use and easily transportable by the user.

I claim:

1. A safety razor assembly comprising:

a plurality of discrete elements disposed in stacked relation one with the other each of said elements having an upwardly projecting wall structure providing a housing having a shaving head disposed therein and a downwardly projecting wall structure forming a cavity for receiving a shaving head housing of another element in interfitting engagement therewith, whereby each of said elements is stackable one on the other to form a handle means for employing the upper most element when the assembly is utilized in a shaving process.

2. A safety razor assembly as set forth in claim 1 which further comprises an overcap means, said overcap means having an upwardly projecting wall structure forming a protuberance and a downwardly projecting wall structure forming a cavity, said overcap upwardly projecting protuberance wall structure being dimensioned for interfitting engagement into a cavity of a said discrete element and said overcap cavity being dimensioned for receiving the shaving head housing of one of said elements in interfitting engagement whereby said overcap means may be assembled at the top or the bottom of a plurality of discrete elements in stacked relation one with the other.

3. A safety razor assembly as set forth in claim 1 wherein each of said elements is dimensionally identical one with the other.

4. A safety razor assembly as set forth in claim 1 wherein each said shaving head housing is substantially rectangular in horizontal cross-section.

5. A safety razor assembly as set forth in claim 1 wherein each said cavity is substantially rectangular in horizontal cross-section.

6. A safety razor assembly as set forth in claim 1 wherein an outer dimension of each said shaving head housing and a mating inner dimension of each said cavity provide an interference fit when a shaving head housing of one said element is in interfitting engagement with a cavity of another said element.

7. A safety razor assembly as set forth in claim 1 wherein each said upwardly projecting wall structure and each said downwardly projecting wall structure is formed of a resilient plastic material.

8. A safety razor assembly as set forth in claim 2 wherein each of said elements is identical one with the other.

9. A safety razor assembly as set forth in claim 8 wherein each said shaving head housing is substantially rectangular in horizontal cross-section.

10. A safety razor assembly as set forth in claim 9 wherein each said cavity is substantially rectangular in horizontal cross-section.

11. A safety razor assembly as set forth in claim 10 wherein an outer dimension of each said shaving head housing and a mating inner dimension of each said cavity provide an interference fit when a shaving head housing of one said element is in interfitting engagement with a cavity of another said element.

12. A safety razor assembly as set forth in claim 11 wherein each said upwardly projecting wall structure and each said downwardly projecting wall structure is formed of a resilient plastic material.

* * * * *